US005114068A

United States Patent [19]

Reil et al.

[11] Patent Number: 5,114,068

[45] Date of Patent: May 19, 1992

[54] APPARATUS FOR THE SEPARABLE ATTACHMENT OF TWO SYNTHETIC PLASTICS PARTS AND THE USE OF THE APPARATUS FOR A PACKAGE TO CONTAIN FLOWABLE CONTENTS

[75] Inventors: Wilhelm Reil, Bensheim; Ulrich Deutschbein, Mühltal; Gerd Knobloch, Griesheim; Udo Liebram, Pfungstadt, all of Fed. Rep. of Germany

[73] Assignee: Tetra Pak Holdings & Finance S.A., Pully, Switzerland

[21] Appl. No.: 594,257

[22] Filed: Oct. 9, 1990

[30] Foreign Application Priority Data

Oct. 25, 1989 [DE] Fed. Rep. of Germany ..... 3935480

[51] Int. Cl.[5] ..... B65D 51/00

[52] U.S. Cl. ..... 229/123.2; 220/270; 220/276; 220/359; 229/125.35; 428/43; 428/167

[58] Field of Search ..... 206/608, 611, 628, 629; 229/123.2, 123.3, 125.35; 220/266, 270, 276, 359; 428/43, 167

[56] References Cited

U.S. PATENT DOCUMENTS

| | | | |
|---|---|---|---|
| 2,941,660 | 6/1960 | Tupper | 229/123.2 |
| 2,998,158 | 8/1961 | Tupper | 220/276 |
| 3,153,492 | 10/1964 | Clair, Jr. | 220/270 |
| 3,450,300 | 6/1969 | Saunders . | |
| 3,515,334 | 6/1970 | Jacobson | 229/123.2 |
| 3,535,409 | 10/1970 | Rohde | 428/43 |
| 3,580,485 | 5/1971 | Hall . | |
| 3,812,002 | 5/1974 | Lurie | 428/43 |
| 4,301,940 | 11/1981 | Cyacho | 220/258 |
| 4,465,205 | 8/1984 | Sutoh | 220/276 |
| 4,474,304 | 10/1984 | Jacobs | 220/276 |
| 4,501,375 | 2/1985 | Katsura et al. | 220/270 |
| 4,533,063 | 8/1985 | Buchner et al. | 220/270 |
| 4,638,911 | 1/1987 | Prohaska | 206/611 |
| 4,759,463 | 7/1988 | Mazoin | 220/359 |
| 4,913,307 | 4/1990 | Takata et al. | 220/359 |
| 4,948,441 | 8/1990 | Peck | 428/43 |

FOREIGN PATENT DOCUMENTS

| | | | |
|---|---|---|---|
| 778231 | 2/1968 | Canada | 220/270 |
| 1883369 | 10/1960 | Fed. Rep. of Germany . | |
| 2124931 | 5/1971 | Fed. Rep. of Germany . | |
| 8604128 | 2/1986 | Fed. Rep. of Germany . | |
| 8712718 | 9/1987 | Fed. Rep. of Germany . | |
| 8901080 | 1/1989 | Fed. Rep. of Germany . | |
| 1290506 | 3/1962 | France | 220/270 |
| 1307999 | 9/1962 | France | 220/270 |
| 2599004 | 11/1987 | France | 220/276 |
| 1478580 | 7/1985 | U.S.S.R. . | |
| 1524803 | 1/1986 | U.S.S.R. . | |
| 2115392 | 9/1983 | United Kingdom | 220/276 |

*Primary Examiner*—Gary E. Elkins
*Attorney, Agent, or Firm*—Biebel & French

[57] ABSTRACT

An apparatus for the separable attachment of a lid (1') to a bottom part is described, both parts being connected to each other by a first welded seam (3), a first tear line (5) being provided which extends parallel with the first welded seam (3).

In order no longer to have to tear the lid upwards or even bend it and in order to be able to provide such a tearing-open device for a package, it is according to the invention proposed that at a distance (a) from the first tear line (5) and at least along a first portion (5) thereof, a second tear line (4) be so disposed to extend in the lid (1') that a tear-off strip (6) can be formed between the two tear lines (4, 5).

7 Claims, 7 Drawing Sheets

APPARATUS FOR THE SEPARABLE ATTACHMENT OF TWO SYNTHETIC PLASTICS PARTS AND THE USE OF THE APPARATUS FOR A PACKAGE TO CONTAIN FLOWABLE CONTENTS

The invention relates to an apparatus for the separable attachement of a first synthetic plastics part to a second plastics part both being connected to each other by a first welded seam, a first tear line being provided which extends parallel with the first welded seam. Furthermore, the invention relates to a use of this apparatus for the attachment of a lid to a package and relates to a package for fluid and/or solid contents, consisting of a tub-shaped bottom part and a lid, the lid and at least the upper edge of the bottom part consisting of a synthetic plastics material. The shape of the bottom part can of course also be understood as a beaker, a carton or a plate. For these shapes of bottom parts, the term "tub-shaped" will be used as representative of them all.

Generally, in the case of parts which consist of synthetic plastics material, the most widely diverse attachment possibilities, methods and problems arise, the term synthetic plastics parts within the meaning of the present invention being understood to be a web or sheet-like material.

The usual way of connecting a first synthetic plastics part to a second is of course welding or sealing. If it is then desired to detach one part from the other, then of course a first tear line is provided which usually extends parallel with the aforesaid first welded seam. In this way, it is possible to take hold of the first synthetic plastics part and separate it from the second synthetic plastics part along the tear line, the first welded seam remaining on the second synthetic plastics part.

In many cases, it has been found to be disadvantageous to have to bend the first synthetic plastics part in relation to the second, at least in the region of the first tear line, but otherwise the first synthetic plastics part cannot be torn away from the second. Particularly in the case of synthetic plastics parts which have profiles, bending may either be impossible or may result in damage so that a remedy must be provided.

The object of the invention, therefore, is to provide an apparatus for separable attachment, of the type mentioned hereinabove, in which the second synthetic plastics part no longer has to be torn upwards or even bent in order to allow it to be torn along the first tear line; and the problem also resides in providing fresh application possibilities and particularly in the new configuration of a package of the type already mentioned in which the bending of a lid is particularly undesirable.

Where the separable attachment apparatus in general is concerned, the problem according to the invention is resolved in that at a distance from the first tear line a second tear line is so disposed to extend in the first synthetic plastics part at least along a first portion thereof that a tear-off strip can be formed between the two tear lines. The tear-off strip only requires small quantities of material and can be provided as waste without any substantial losses, whether the tear-off strip is separated after the tear-off process and is thrown away or remains attached to one of the two synthetic plastics parts. Since it is absolutely necessary and unavoidable that one part should be bent in relation to the other along a tear line, the measures according to the invention mean in any case that the tear-off strip which is imagined to be waste material is taken to be that part which can be bent without further damage, making it possible to tear off one part from the other.

It has been found to be advantageous for the first tear line to extend on the strip-side edge of the first welded seam while the second tear line is formed at least along a first portion of the first tear line through a separate line of weakness in the first synthetic plastics part. Indeed, it is possible also to provide in addition to the first welded seam a separate line of weakness so that this forms the first tear line. However, this expenditure on labour and materials is not necessary because on the side of the tear-off strip the edge of the first welded seam simultaneously forms a tear line. In fact, when the user tears the tear-off strip upwards, it becomes separated along the strip-side edge of the first welded seam. Thus, the first synthetic plastics part can be separated from the second part whether by folding it up hinge-wise or by separating it. The tear-off strip is preferably narrow and elongated in construction and is bounded on one side by the strip-side edge of the first welded seam while on the other side it abuts the second tear line which is for example a separate line of weakness provided in the first synthetic plastics part.

According to the invention, it is furthermore expedient if the second tear line is formed along a second portion of the first tear line by a second welded seam which extends substantially in prolongation of the second tear line. In this case, the second synthetic plastics part is held securely along the second portion and hinge-like on the first synthetic plastics part, whereas in the rest, following on from the end of the second welded seam, there extends the second tear line along which it is possible to separate the first synthetic plastics part from the second.

It has been found to be particularly favourable to use the apparatus of the above-mentioned type for attaching a synthetic plastics top or lid to a package in which at least the top edge consists of a synthetic plastics material which can be welded to the synthetic plastics material of the lid. Such a package can then be produced economically and with simple means and can also be readily handled by the end user. In fact, either the lid can be removed entirely from the package by means of the tear-off strip or it can be lifted up hinge-wise. In the latter case, the possibility of re-closure is particularly simplified.

The teaching according to the invention is therefore directed at a package for fluid and/or solid contents and which consists of a tub-like bottom part and a lid, the lid and at least the upper edge of the bottom part consisting of synthetic plastics material. Such packages can be used for instance for foodstuffs which simultaneously contain solid and fluid components. Such a package can be inexpensively produced in large quantities, good sealing-tightness and strength properties making it suitable for transport and for storage and also favourable for the end user, especially if, as in accordance with the invention, there is provision for a first welded seam to be provided substantially along the top edge of the bottom part between the edge and the lid and if, to form a tear-off strip towards the middle of the lid, there is at a distance from the first welded seam a line of weakness and/or a second welded seam which is/are provided to encircle the entire top edge of the bottom part. It is expedient thereby if the first welded seam which represents the main attachment of the lid to the encircling edge of the bottom part of the package extends on the outside and encircles the upper edge except for one portion which is about the width of a thumb. This exception is provided for a gripper tongue which will be described in greater detail hereinafter. As a result of the first welded seam, therefore, the lid is rigidly connected to the package so that the package can be described as closed. Opening the lid is effected via the tear-off strip which is formed in the manner described, a complete separation of the lid occurring after opening when the encircling line of weakness is at a distance from the first welded seam without being replaced by a second welded seam along a specific portion. Since the line of weakness forms the second tear line, the lid can understandably be removed after opening if this line of weakness encircles the entire upper edge of the bottom part. On the other hand, if a part of this line of weakness is replaced by a welded seam, then the above-described hinge effect is created with the advantage of a ready capacity for re-closure.

In the case of such a package, it is particularly advantageous for the first tear line to extend on the strip-side edge of the first welded seam while the second tear line is formed along a first portion of the first tear line by a separate line of weakness in the lid and along a second portion of the first tear line by a second welded seam. This then extends in prolongation of the second tear line or is adjacent to it. In the region of the second portion, therefore, the hinge is formed via which the lid remains attached to the edge of the bottom part of the package.

According to the invention, it is particularly favourable if for the package described here the tear-off strip is connected to the top edge of the bottom part via a welded attachment point and if this latter preferably connects the first welded seam to the second welded seam. The tear-off strip is then not completely separated and thrown away after it has been torn upwards but remains attached to the edge of the bottom part. This is achieved via the said welded adhesion point. This is a weld area of about 0.5 to 4 $cm^2$ and preferably 1 to 3 $cm^2$. Alternatively, this weld attachment point may also be an extension of the first and/or the second welded seam because according to the foregoing teaching the weld attachment point is intended to provide a connection between the two welded seams. In plan view of the lid and the upper edge of the bottom part of the package, if one observes the first welded seam which is disposed on the outside in respect of the centre of the lid, then the first welded seam is interrupted in the region of the gripper tongue which is as yet to be described; i.e. if one follows it from its start, in the direction of tearing, to behind the gripper tongue which is still to be described, then it runs around the top edge of the bottom part and as far as the said weld attachment point, ending there or passing on to the second welded seam if such is provided in the particular embodiment (in order to form a hinge). In this case, the first welded seam merges via the weld attachment point into the second welded seam and extends from the weld attachment point (further in tear-open direction) and at a relatively small distance from the centre of the lid. At the end of the hinge or at the end of the second welded seam, if one were to continue the path in the tearing-open direction, then one would find the adjacent second tear line which extends around in the manner described and which, were it to be continued further in the tearing-open direction, would likewise end at the weld attachment point.

In an advantageous further development of the invention, the first welded seam is alongside the weld attachment point for the tear-off strip, interrupted along a gripper tongue the length of which is 0.5 to 3 cm and preferably 1 to 2 cm, seen in the tearing-open direction. This gripper tongue may even project beyond the outer edge of the lid so that the end user will immediately recognise the function of the gripper tongue. In the case of a foodstuffs package, the man skilled in the art could see that the interior of the package is theoretically not completely isolated from the outside by a welded seam or a plurality of welded seams. In actual fact, it is expedient according to the invention, in the case of a gripper tongue, to provide the second welded seam beside the first, in the so-called second portion, so that in the region of the second portion, so to speak between the two welded seams, a long and narrow channel is formed which during the welding process and thus when pressing the lid edge down onto the edge of the bottom part, is so pressed together that a fluid-tight and, according to practical experiments even a gas-tight, package is provided without the theoretical welded joint which has been mentioned.

According to the invention it is particularly expedient if the lid is substantially quadrilateral in plan view, rounded corners also being quite feasible, so that four more or less straight edges of the same and/or different length are formed. Along one specific one of the four straight edges, along which then the above-mentioned second portion extends, there are between the lid and the bottom part two welded seams which are at a distance from each other, so that according to the invention the first welded seam extends from a first end of the gripper tongue and around to its other second end. The first welded seam ends so to speak at the weld attachment point on this other second end of the gripper tongue. Furthermore, it is expedient thereby for the second tear line to extend from the second end of the gripper tongue to the opposite end of the specific straight edge of the lid on the strip side, along the second welded seam which extends thereon and then to pass along the other three edges in one piece as far as the weld attachment point for the tear-off strip. By the fact of being attached at the weld adhesion point, the tear-off strip remains attached to the bottom part after it has been torn upwards, this tearing upwards process resulting in the two mutually parallel tear lines forming a tear-off strip, the first tear line being understood as being on the outside in relation to the lid centre while the second tear is understood to be farther inwards. The second tear line extends substantially like the onset of a helix because one end of it, when viewed in plan, and in relation to the centre of the lid, is disposed on the lid and within the other end.

The situation is very similar in the case of the first welded seam which, starting from the first end of the gripper tongue and extending in the tearing-open direction, encircles the edge as far as the other second end of the gripper tongue where, in the case of the embodiment with the second welded seam in the region of the weld attachment point, it is diverted onto a smaller radius or a lesser distance from the lid centre and is changed into the second welded seam which, in the region of the second portion which is for practical purposes the region of the hinge, extends on the other side of the tear-off strip and parallel with the first welded seam until the second welded seam stops at the end of the hinge and merges into the second tear line. In the region of the hinge of the package. the pattern of the two welded seams can be regarded as substantially spiral, because the second welded seam is disposed within the start of the first welded seam.

Particularly when using the fixing apparatus for packages, it has been found to be advantageous for the bottom part of the package or the so-called second synthetic plastics part to be thicker and stiffer than the lid or the first synthetic plastics part. In the case of a particularly preferred embodiment, it is expedient for the bottom part to be produced from a 1 mm thick synthetic plastics material while the lid or the first synthetic plastics part is produced from a 0.4 mm thick synthetic plastics material. For example, it is also expedient for the bottom part of the package and/or the lid to be deep drawn. The package and the attachment apparatus, when applied to such a package, are particularly interesting in conjunction with two synthetic plastics foils or sheets or webs which have to be sealed, as already mentioned above. These synthetic plastics materials preferably form the relevant foil, sheet or web in one piece, so that it is possible to provide parts such as packages which can be particularly well prepared (in contrast to composite materials). A particularly expedient synthetic plastics material is polypropylene which, again in a particularly advantageous embodiment, can be filled, for example have up to a 60% filling. Suitable fillers are chalk, mica, talcum, gypsum or the like. Also such filled synthetic plastics materials can be deep drawn and sealed. It has been demonstrated that filled synthetic plastics materials are even capable of being torn.

Further advantages, features and possible applications of the present invention will emerge from the following description of preferred examples of embodiment, in conjunction with the accompanying drawings, in which:

FIG. 1 is a perspective view of two foils fixed to each other and with a partially upwardly torn tear-off strip in the upper thinner foil which is referred to as the first synthetic plastics part, FIG. 2 is a diagrammatic and broken-away sectional view taken on the line II—II in FIG. 1, FIG. 3 is a similar view taken on the section line III—III, FIG. 4 is a plan view of a large underlying and thicker foil referred to as the second synthetic plastics part and, resting on it, a smaller and thinner foil which is referred to as the first synthetic plastics part and which has a bent tear-off strip and welded seams or tear lines, FIG. 5 is a broken-away sectional view taken on the line V—V in FIG. 4, FIG. 6 is a plan view of the lid of a rectangular package for flowable media, indicating the welded seams and tear lines, FIG. 7 is a sectional view taken on the line VII—VII in FIG. 6 to illustrate the shape of the package.

FIG. 8 is a diagrammatic and broken-away sectional view taken on the line VIII—VIII in FIG. 6, FIG. 9 is a view similar to that in FIG. 8 but after removal of the tear-open strip with the gripper tongue, FIG. 10 is a similar sectional view taken on the line X—X in FIG. 6, FIG. 11 is a likewise broken-away and sectionally shown view as in FIG. 10, but showing the tear-open strip in the pulled up position, FIG. 12 is a similarly sectional view through the marginal portion of the bottom part of the package according to the section line XII—XII in FIG. 6.

Figure 1:
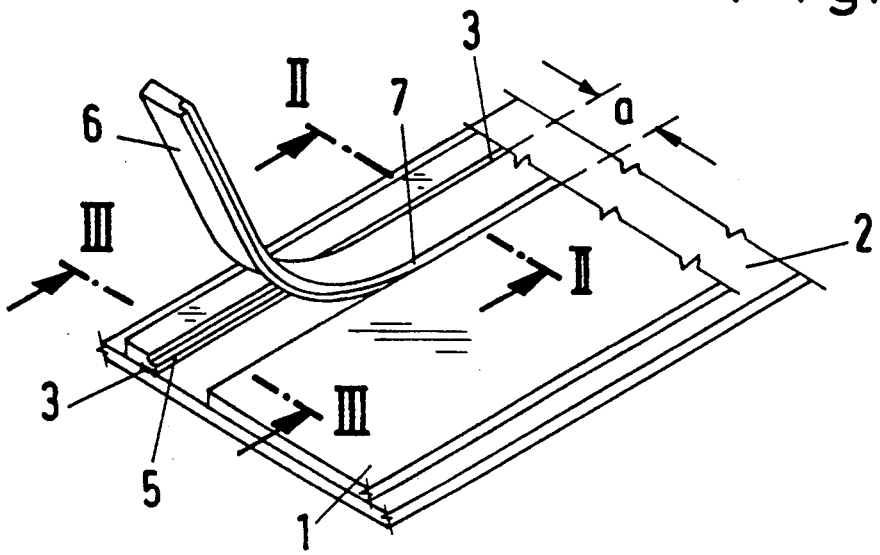
Figure 2:
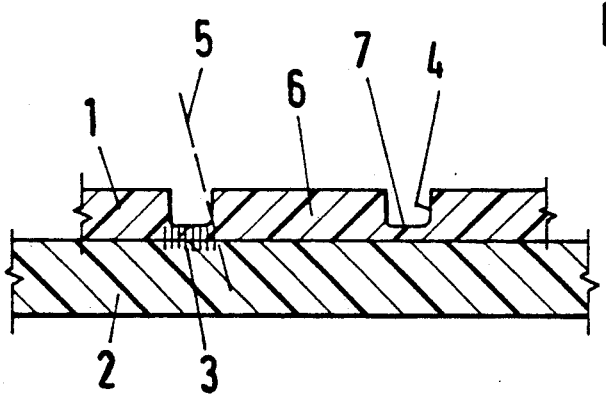
Figure 6:
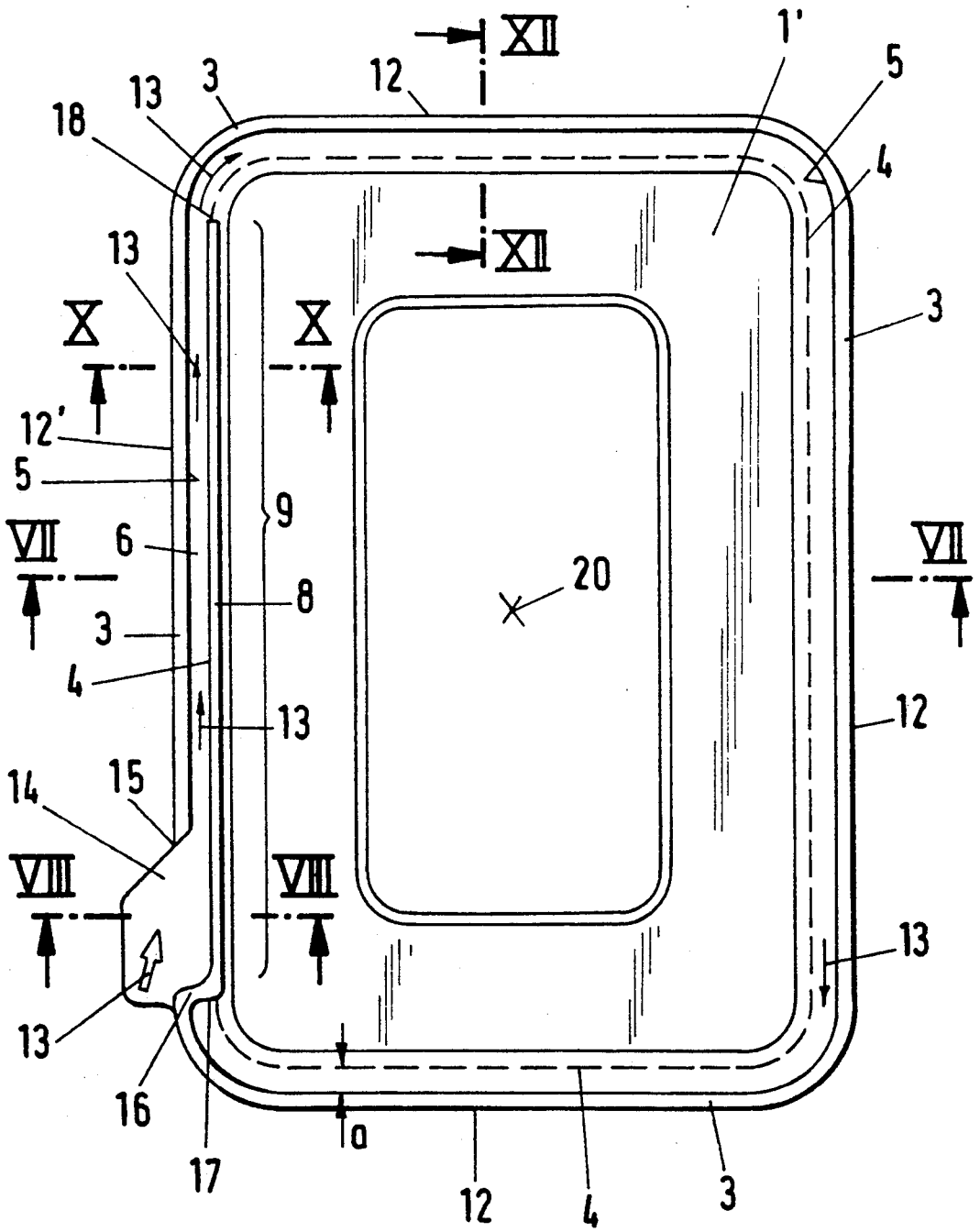
Figure 7:
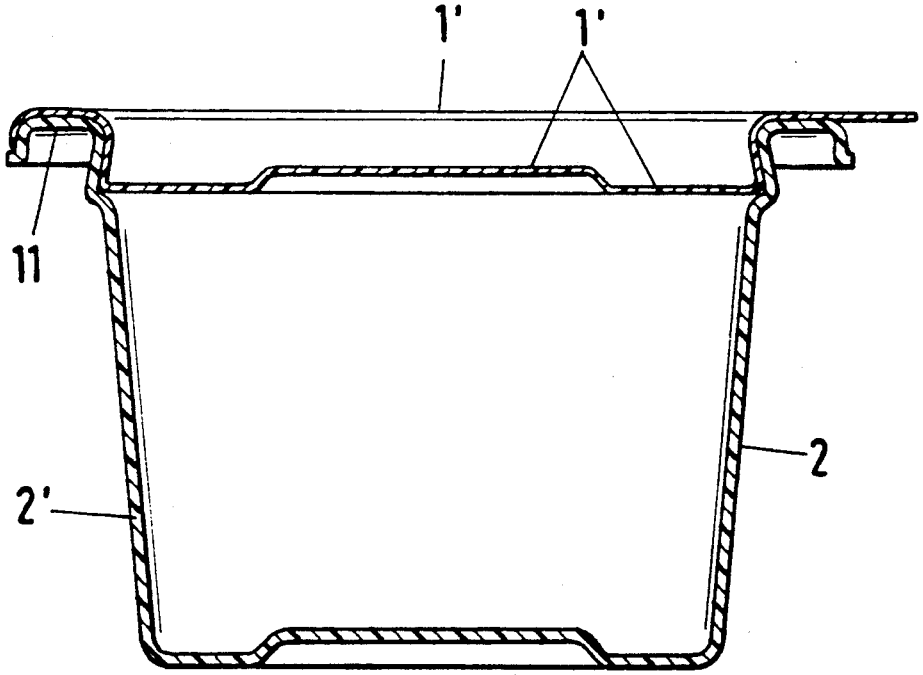
Figure 8:
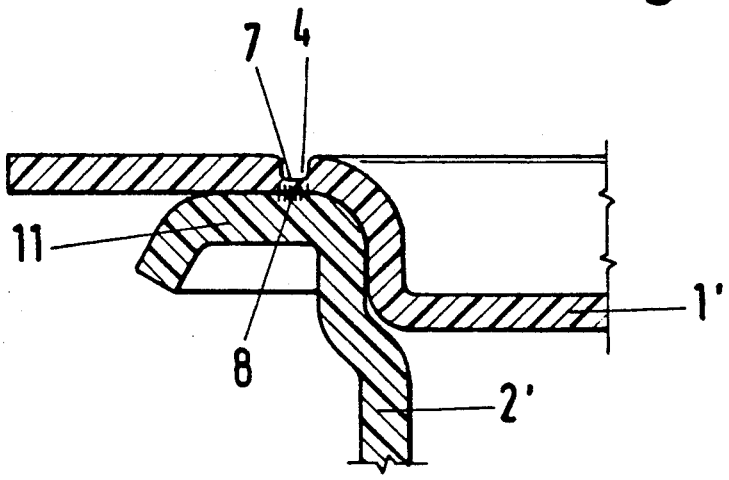
Figure 9:
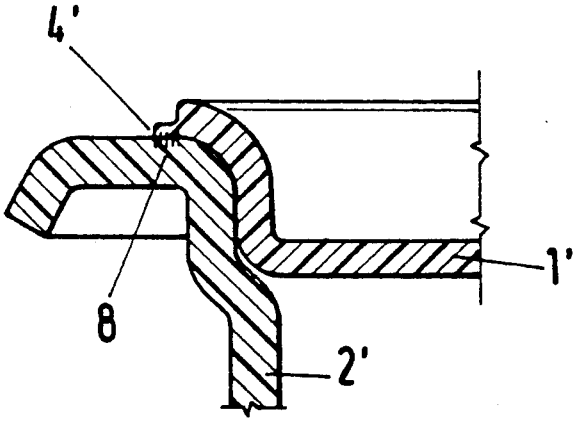
Figure 10:
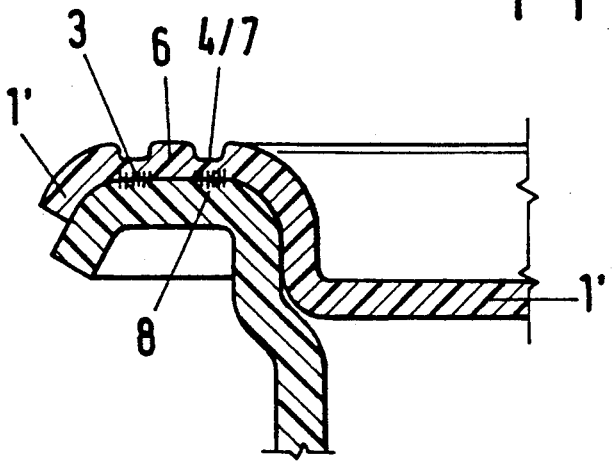
Figure 11:
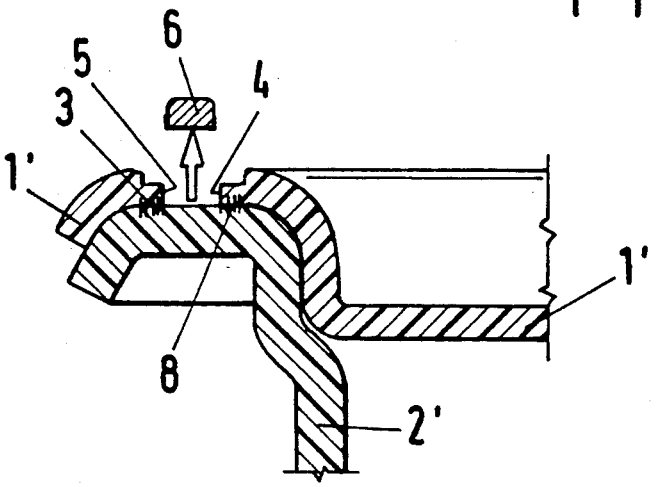
Figure 12:
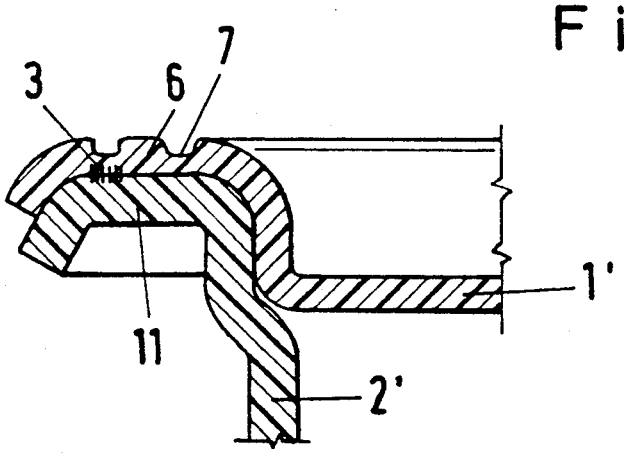

A film of synthetic plastics material which is shown in the drawings as being generally larger in plan view and thicker in cross-section is here termed the second synthetic plastic part 2 which in the case of the package shown in FIGS. 6 to 13, corresponds to the bottom part 2' of the said package. It is intended to attach to this second synthetic plastics part 2 a first synthetic plastics part 1 which is the (in plan view) generally smaller and in cross-section generally thinner foil part. In the case of the package according to FIGS. 6 to 13, this is the lid 1'. These two synthetic plastics parts 1' and 2 or the lid 1' of the package and its bottom parts 2' are connected to each other by a first welded seam 3. This may be rectilinear as in FIGS. 1 to 3 or may be curved and rectilinear, as shown in FIGS. 4 and 6. Parallel with the first welded seam 3, i.e. at a distance a, there extends a second tear line 4. To be more exact, the second tear line 4 extends at a distance a from and parallel with a first tear line 5 which is indicated by a broken line in FIGS. 2 and 15. This first tear line 5 forms at the edge of the first welded seam 3 which is towards the middle 20 of the lid 1' because when the tear-off strip 6 disposed between the two tear lines 4 and 5 is torn upwards, it is automatically separated alongside the first welded seam 3. Therefore, the first tear line 5 extends in the strip-side edge of the first welded seam 3.

Figure 3:
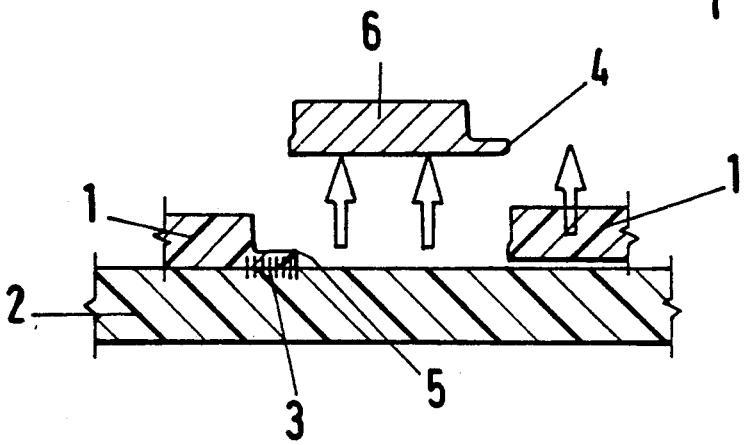
Figure 4:
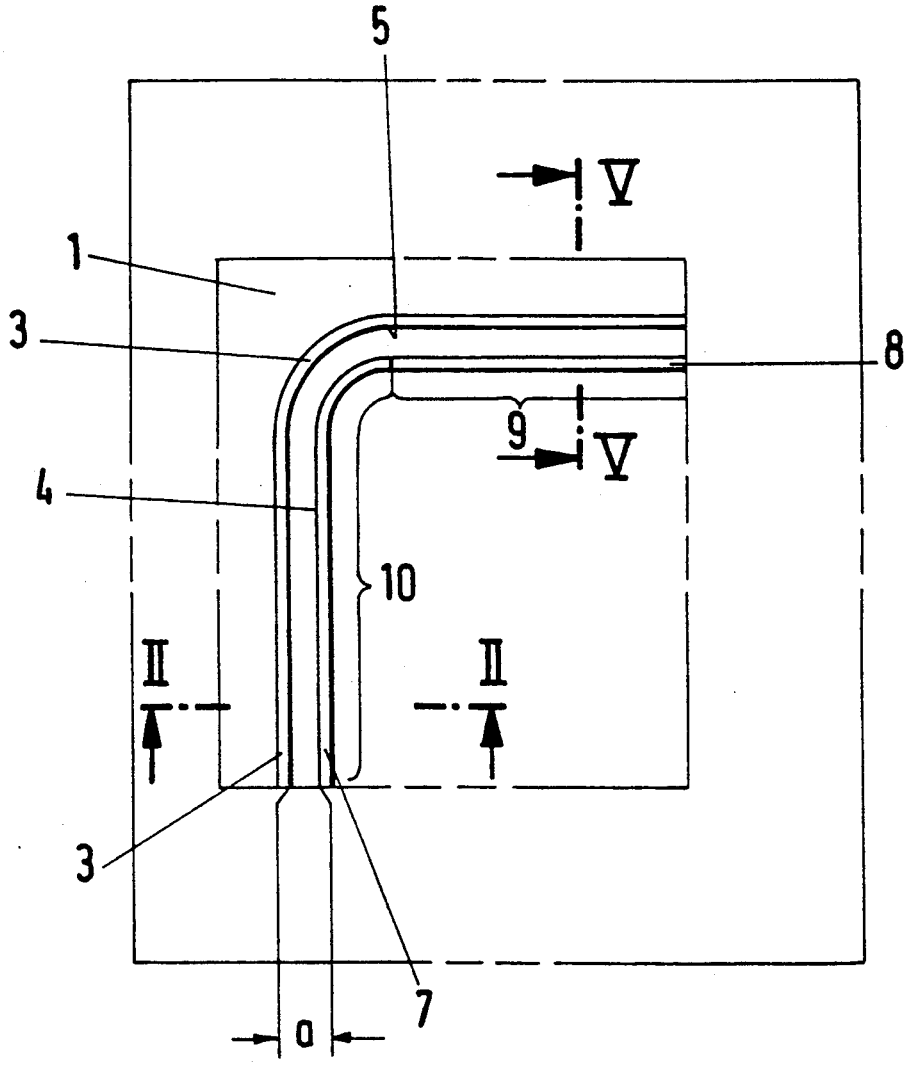
Figure 5:
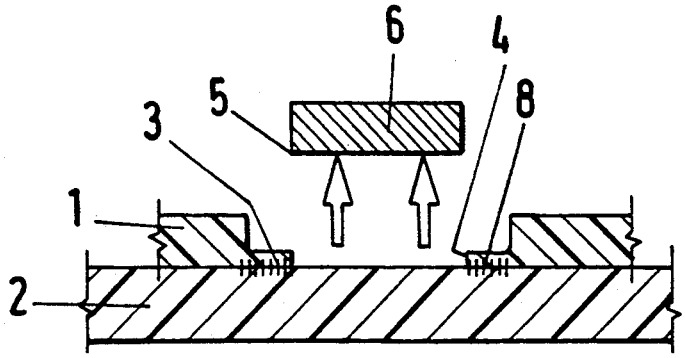
Figure 13:
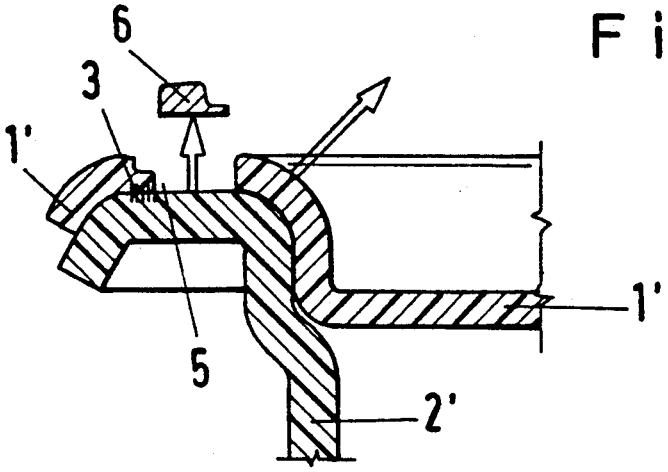
FIG. 13 is a view which is the same as that in FIG. 12 but in which the tear-off strip is pulled up.
Figure 14:
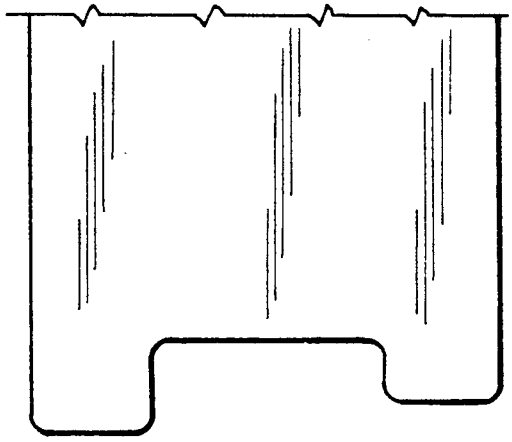
FIG. 14 shows a tool for making the first welded seam and the tear lines and FIG. 15 shows a broken-away cross-sectional view of two synthetic plastic parts, on an enlarged scale, produced after the action of the tool shown in FIG. 14.
Figure 15:
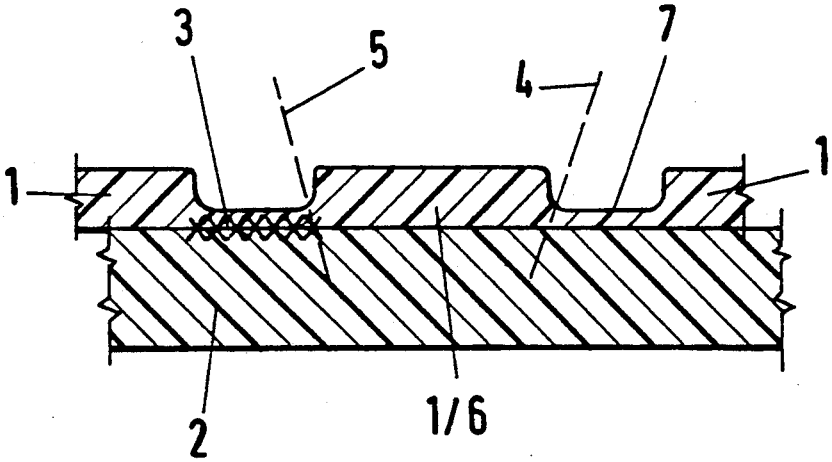

The second tear line 4 may be formed by a separate line of weakness 7 in the first synthetic plastics part 1 or in the lid 1' so that when the tear-off strip 6 is pulled up, there is a tearing off along the second tear line 4, as indicated by the broken line in FIG. 15 or also as shown in FIGS. 3 and 13. However, the second tear line 4 can also be formed by a second welded seam 8 which is disposed in a so-called second portion 9. On the other hand, there is in the first portion 10 only one, namely the second tear line 4 which therefore starts at the end of the second portion 9 and ends at the beginning of the second portion 9. In the case of the embodiment shown in FIG. 4, the bottom straight and, adjacent thereto, the top curved portion within the double line is this first zone 10 which is continued upwardly behind the curved portion and to the right into the second portion 9. It will be understood that due to the sharp edge alongside the inner second welded seam 8 and on the strip side edge, there, the second tear line 4 is formed, the first tear line 5 being formed at the first welded seam 3.

If one studies the package shown in FIGS. 6 to 13, then with regard to the above generally described attachment apparatus, particularly the upper edge or ledge 11 of the bottom part 2' will be noted, as it occurs in FIGS. 8 to 13 in all the enlarged sectional views.

In the case of the embodiment shown in FIG. 6, the lid 1' is substantially rectangular in plan view and has rounded corners. It has three straight edges or sides 12 and a fourth straight edge or side 12' which is shown on the left in FIG. 6 and tears open the second portion 9. In this portion, i.e. lengthwise of this specific straight edge 12' of the four straight edges of the lid 1' lie the two welded seams 3 and 8 which are at a distance a from each other so that in this secopnd portion 9 there is formed the hinge for the lid 1'. At the bottom on the left in the tear-open direction indicated by the arrow 13, in FIG. 6, there is firstly the gripper tongue 14 the upper end of which is called the first end 15. Extending upwardly from this end 15, in the direction of the left-hand arrow 13, i.e. in the tear-open direction, is the first welded seam 3 which extends over the entire second portion 9 and then upwardly via the first curved rightwardly into the next straight side edge 12, then to the right again downwards into the next straight side edge 12 and at the bottom on the right in a clockwise direction along the curved arrow 13 into the bottom straight edge 12, so producing an encircling pattern around the outer edge of the lid 1' as far as the other second end 16 of the gripper tougue 14. This second end 16 is shown in FIG. 6 at the bottom on the left on the gripper tongue 14, i.e. with regard to the gripper tongue 14, it is opposite the first end 15 thereof. Here at this second end 16 of the gripper tongue 14 the first welded seam 3 ends in a weld attachment point 17. FIG. 6 shows how the weld attachment point 17 extends over the distance a from the outside inwardly, i.e. ensures the connection between the first welded seam 3 and the second welded seam 8.

Important for the opening process is the commencement of the second tear line 4 which is shown in FIG. 6 on the inside by the broken line and which in the second portion 9 occurs on the strip-side edge of the second welded seam 8. This edge starts at the second end 16 of the gripper tongue 14 and extends from here in the view shown in FIG. 6 on the left-hand side of the weld attachment point 17 and upwardly, still on the left-hand edge of the second welded seam 8 as far as the upper end 18 of the second portion 9, i.e. as far as the end 18 of the second welded seam 8 which then, without interruption, merges upwards into the second tear line 4 and continues in the manner described until after passing all round and along the three lateral edges 12 of the lid 1' it reaches the weld attachement point 17 where the second tear line 4 ends.

From the gripper tongue 14 in the bottom left-hand corner of FIG. 6 to the upper end 18 of the second portion 9 or the end of the specific straight edge 12' of the lid 1' extends a channel which is open from the outside inwardly and which passes between the two welded seams 3 and 8 which in practice is closed after the closing welding or opening welding of the lid 1' onto or off the top edge 11 of the bottom part 2', and is even found to be gas-tight.

The opening process now takes place in that the user takes hold of the gripper tongue 14 and pulls the tear-off strip 6 upwards in the direction of the arrow 13. The sectional view taken on the line VIII—VIII in FIG. 6 then changes from the view in FIG. 8 to that shown in FIG. 9. Upon further outwards tearing of the tear-off strip 6, the situation in the marginal zone along the line X—X then alters from the closed state in FIG. 10 into the open state shown in FIG. 11. Upon further outwards tearing, then accordingly at the level of the line XII—XIII in FIG. 6, the situation in FIG. 12 becomes changed to that in FIG. 13. The tear-off strip 6 is further torn in a clockwise direction and finally remains attached at the weld attachment point 17. In the second portion 9, along the second welded seam 8, the hinge is formed about which the lid 1' can be raised, as if about an axis of rotation and then closed again after complete or partial emptying of the package.

We claim:

1. A packge for containing fluids or solids including a tub-shaped bottom part and a top enclosing said bottom part about an upper sealing edge of the bottom part and at least said upper sealing edge of said bottom part and said top being formed of synthetic plastic material, comprising:

means defining a first welded seam extending generally circumferentially of said top along said upper sealing edge between said upper sealing edge and said top joining said bottom part at said upper sealing edge to said top, said first welded seam defining a first tear line along a lateral edge of said seam, means in said top forming a circumferentially extending tear-off strip defining an inner edge and an outer edge, and in which said outer edge of said strip is joined to said upper sealing edge along said first welded seam, said tear-off strip inner edge being defined, in part, by a line of weakness in said top and part by a second welded seam formed as a continuation of said line of weakness and connecting said top to said upper sealing edge of said bottom part, whereby the removal of said tear strip by separating the same along said first welded seam and along said line of weakness and said second welded seam separates said top from said bottom part along said line of weakness and leaves said top attached to said bottom part along said second welded seam.

2. A package according to claim 1 further in which said second tear line is formed along a first portion of said first tear line by a separate line of weakness in said top and along a second portion of said first tear line by said second welded seam.

3. A package according to claim 1 further comprising a welded attaching point connecting said upper sealing edge of said bottom part to said tear-off strip, said welded attachment point extending between and connecting said first welded seam to said second welded seam.

4. A package according to claim 3 further comprising a gripper tongue as an integral part of said tear-off strip, said gripper tongue being positioned on said strip adjacent said attachment point, said tongue forming an interruption in the continuity of said first welded seam.

5. The package according to claim 4 further comprising the fact that said bottom part and said top are substantially quadrilateral in plan view, thereby defining, in said top, four straight edges, said first and second welded seams extending parallel to each other in spaced-part relation along one of said straight edges.

6. The package of claim 5 in which said tongue is positioned alongside said one straight edge.

7. The package according to claim 6 in which said first welded seam extends from said gripper tongue at a first end thereof circumferentially of said package and terminates at said tongue at a second end thereof, and in which said second tear line extends from said attachment point adjacent said second end of said tongue circumferentially and terminates at an end of said second welded seam remote from said tongue.

* * * * *